US005197210A

United States Patent [19]

Sink

[11] Patent Number: 5,197,210

[45] Date of Patent: Mar. 30, 1993

[54] ATHLETIC SHOE

[76] Inventor: Jeffrey A. Sink, 154 Santiago Ave., Redwood City, Calif. 94061

[21] Appl. No.: 844,975

[22] Filed: Mar. 2, 1992

Related U.S. Application Data

[63] Continuation of Ser. No. 774,176, Oct. 15, 1991, abandoned, which is a continuation of Ser. No. 700,940, May 13, 1991, abandoned, which is a continuation of Ser. No. 634,960, Jan. 2, 1991, abandoned, which is a continuation of Ser. No. 436,472, Nov. 20, 1989, abandoned.

[51] Int. Cl.[5] ..... A43B 5/00

[52] U.S. Cl. ..... 36/127

[58] Field of Search ..... 36/127, 128, 134, 124, 36/115, 113, 67 A, 66, 62, 59 A, 67 D

[56] References Cited

U.S. PATENT DOCUMENTS

| | | | |
|---|---|---|---|
| 769,787 | 9/1904 | Carroll | 36/62 |
| 1,696,058 | 12/1928 | Rubin . | |
| 2,203,929 | 6/1940 | Shapiro | 36/134 X |
| 3,979,842 | 9/1976 | Texidor | 36/115 |
| 4,454,662 | 6/1984 | Stubblefield | 36/134 X |
| 4,523,396 | 6/1985 | Dassler | 36/134 |
| 4,676,010 | 6/1987 | Cheskin | 36/59 A |
| 4,742,626 | 5/1988 | Tadiotto | 36/127 |
| 4,803,894 | 2/1989 | Howell | 36/131 X |

FOREIGN PATENT DOCUMENTS

| | | | |
|---|---|---|---|
| 2501561 | 7/1976 | Fed. Rep. of Germany | 36/134 |

*Primary Examiner*—Daniel P. Stodola
*Assistant Examiner*—John P. Darling
*Attorney, Agent, or Firm*—Sterne, Kessler, Goldstein & Fox

[57] ABSTRACT

A golf shoe including an upper portion and a sole portion having one or more flexible grooves or channels formed laterally to bend or flex about the ball of a user's foot when walking to provide for flexibility. The sole also includes one or more slots laterally formed therethrough to receive corresponding slides, each of which have one or more golf spikes formed therein. The slides can be easily removed from the shoe to facilitate changing of spikes when the slide is inserted into the slot and a clamping engagement is formed so as to provide for lateral support when a golfer is swinging a golf club while providing great flexibility when walking.

21 Claims, 7 Drawing Sheets

ATHLETIC SHOE

This application is a continuation of now abandoned Ser. No. 07/774,176 filed Oct. 15, 1991;which is a continuation of now abandoned Ser No. 07/700,940 filed May 13, 1991; which is a continuation of now abandoned Ser. No. 07/634,960 filed Jan. 2, 1991; which is a continuation of now abandoned Ser. No. 07/436,472 filed Nov. 20, 1989.

BACKGROUND OF THE INVENTION

The present invention relates to an improved athletic shoe and more particularly to an improved golf shoe.

A typical golf shoe includes an upper portion (frequently made of leather or other suitable material), an inner or intermediate portion for support purposes and, finally, a sole portion which includes 10–12 screw-in metal spikes for each shoe. The golf spikes provide traction on the golf course so that the shoes do not slide side to side when the golfer is swinging a golf club. The screw-in metal spikes each require a corresponding screw-in metal or plastic receptacle which is usually embedded in the sole of the shoe with threads in it.

One problem with existing golf shoes is that by screwing the spikes into the receptacles, the spikes themselves must be generally arranged towards the center of sole. This leaves considerable room on the outside of the sole so that the shoe can be wobbly and there may not be sufficient support to prevent a sliding action, which of course is undesirable. Also, the spikes must screw into the receptacle, which makes the shoe stiff, which also can be undesirable. The only way to make the shoe more flexible is to use a softer material.

Most golf shoes use the above approach, although different types of materials, different colored spikes and the like may be utilized. The general limitation is that there are only about 10–12 metal spikes for each shoe, which does not provide optimum traction and support. As indicated, it would be desirable that the golf shoe be flexible as the user is walking, but also rigid with respect to side to side or lateral motion when the golfer is swinging a golf club. Prior art approaches do not provide these desired capabilities.

SUMMARY OF THE INVENTION

It is an object of the present invention to provide an improved athletic shoe. It is a more particular object of the present invention to provide an improved golf shoe. It is still another object of the present invention to provide an improved athletic shoe that has traction, flexibility and stability.

Briefly, the present invention, in one preferred embodiment, includes a golf shoe comprising a first upper portion together with a sole formed of a generally flat or planar material having one or more flexible portions (channels or grooves) conformed to flex back and forth about the ball of the user's foot as the user is walking or running.

The sole also includes a plurality of laterally formed slots generally wider than the flex portions across the bottom of the sole. The golf shoe further includes one or more slides of a predetermined width corresponding to the width of the slots, each of which is slidably insertable into the respective slot so as to be placed in a locking or engaging relationship with the sole of the golf shoe. The slides each contain one or more golf spikes which can be arranged in any predetermined pattern.

Other objects, features and advantages of the present invention will become apparent from the following detailed description of the preferred embodiment when taken in conjunction with the accompanying drawings.

BRIEF DESCRIPTION OF THE DRAWINGS

The accompanying drawings which are incorporated in and form a part of this specification illustrate an embodiment of the invention and, together with the description, serve to explain the principles of the invention.

DETAILED DESCRIPTION OF THE PREFERRED EMBODIMENT

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, it is intended to cover alternatives, modifications and equivalents as may be included within the spirit and scope of the invention as defined by the appended claims.

Figure 1:
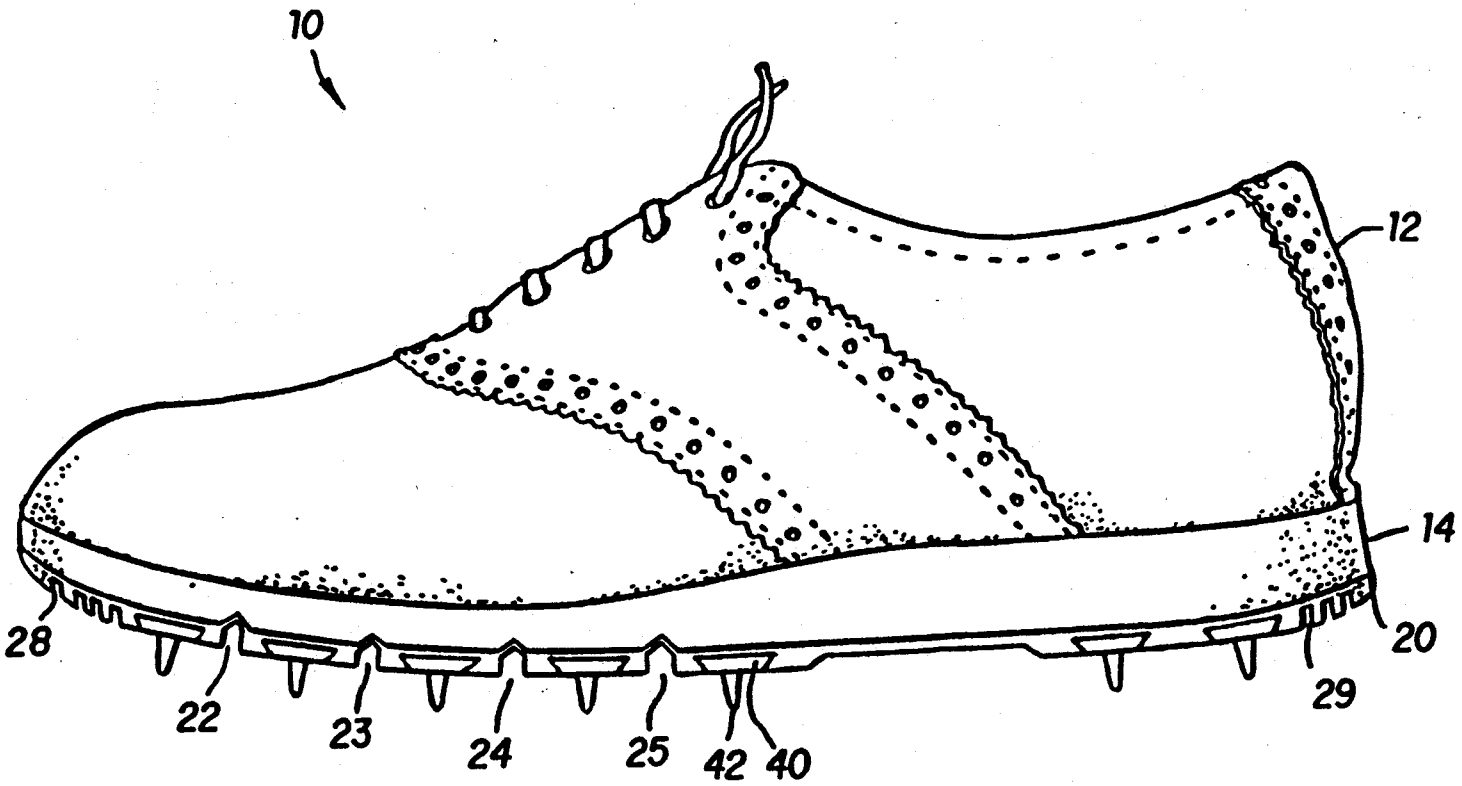
FIG. 1 depicts a side view of an improved golf shoe according to the present invention.

Referring now to FIG. 1, a side view of an improved golf shoe 10 according to the present invention is depicted. In FIG. 1, the golf shoe 10 includes an upper portion 12 generally formed of a leather-type material (although it could be made of other materials, such as canvas), together with an intermediate sole portion or midsole 14 which is typically made of blown plastic foam such as ethylene vinyl acetate (EVA) and an outsole portion 20 (as described below). Midsole 13 and outsole 20 together comprise the shoe sole. However, in some instances, midsole 14 may be omitted, and the shoe sole would comprise an outsole only.

Intermediate portion 14 provides a midsole cushion for the golf shoe 10 and is made of a type of material (EVA) used on many types of athletic shoes.

As noted above, golf shoe 10 of FIG. 1 includes an outsole portion 20 desirably made of a nylon or plastic (sufficiently hard or rigid) type of material which is generally flat and which is glued or affixed to the midsole cushion portion 14. The outsole 20, as will be described, is made with a plurality of flex grooves or channels 22, 23, 24, 25, which flex with respect to the ball of a user's foot. In FIG. 1, there are four grooves or channels 22–25 laterally formed through the plastic or nylon sole 20. There could be different numbers of channels or grooves, as necessary. The sole portion is generally affixed to the upper portion with a polyurethane cement.

As can be seen in FIG. 1, the grooves are tilted at the same angle that the user's foot bends, typically at approximately a 12-degree angle. The tilt aspect of the outsole 20 provides great flexibility as a golfer is walking on the golf course. The rest of the outsole 20 is thick enough to provide rigidity so that the shoe does not bend side to side.

As can be seen in FIG. 1, the grooves, such as groove or channel 22, forms a thin area which could be one of many shapes, such as flat, U-shaped, V-shaped and which provides for the flexing or hinging aspect described above.

The improved golf shoe 10 also includes, as desired, additional channels or grooves 28, 29 at the front and back portions, respectively, of the outsole 20.

The golf shoe 10 of FIG. 1 further includes a plurality of slides, such as slide 40, which slide into locking engagement with corresponding slots formed in the bottom portion of outsole portion 20. The slide 40 includes one or more golf spikes 42 formed thereon. The actual engagement of the slide 40 with a outsole 20 will be shown in other drawings to be described below.

The nylon outsole 20 of FIG. 1 has grooves 22–25 for flexibility, and slots to accommodate a respective slide such as slide 40. The grooves 28 at the front portion of the shoe 10 provide for an improved walking motion. Similarly, the grooves 29 at the rear portion of the shoe also provide for comfortable walking. The front and rear portions of the outsole 20 can also be beveled, as desired.

Figure 2:
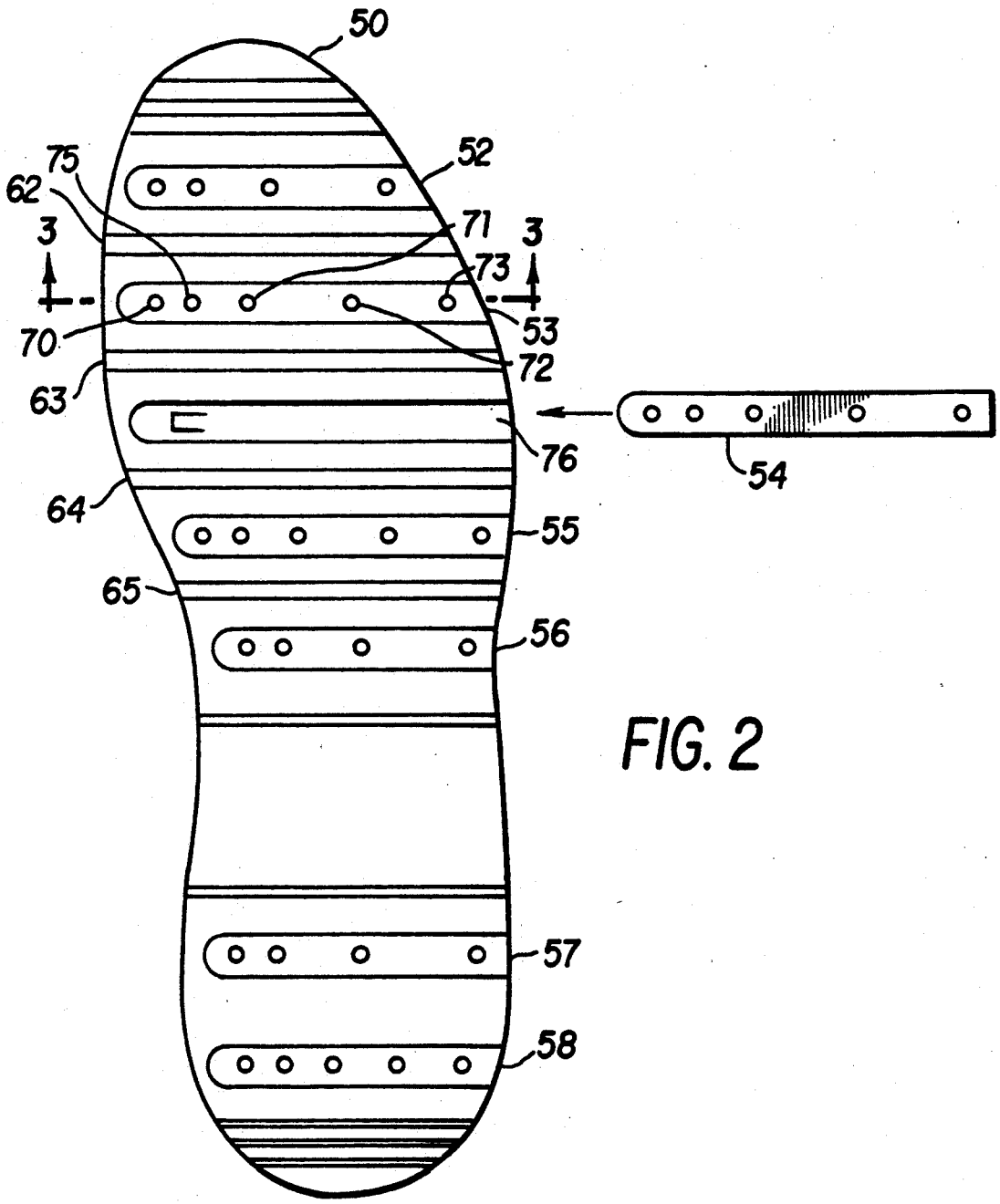
FIG. 2 depicts a view of the bottom of the sole of the improved golf shoe of FIG. 1.

FIG. 2 shows a bottom view of an outsole 50 according to the present invention. The bottom portion of the sole 50 includes a plurality of slots laterally formed thereon which will receive a corresponding slide, such as slides 52, 53, 54, 55, 56, 57, 58. As can be seen in FIG. 2, the bottom portion of sole 50 includes the grooves or channels 62–65 to provide the flex action previously described.

Figure 3A:
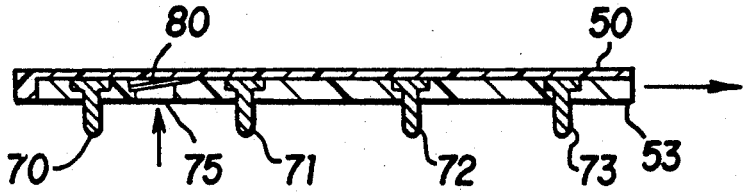
FIG. 3A depicts a cross-sectional view of the sole of the shoe of FIG. 2 taken along line 3—3.

A slide such as slide 53 includes one or more golf spikes 70, 71, 72, 73, embedded in some fashion thereon. The slide such as slide 53 can be made of of a plastic, nylon or rubber type material. The slide 53 also includes a hole 75 formed therethrough so that, when a golf tee (or other suitable tool) is inserted into hole 75, slide 53 can be easily removed from the golf sole 50. This is shown in more detail in FIG. 3B. FIG. 3A shows a cross-sectional view of FIG. 2 taken along line 3—3. In FIG. 3A, it can be seen that the slide 53 includes golf spikes 70–73 formed therein. The slide 53 also includes a spring or bias portion 80 which engages a corresponding portion of the golf sole 50 to form a clamping or engaging relationship. Alternatively, an exterior outer clip portion could be formed on the slide 53 to engage the sole portion 50.

In FIG. 2, slide portion 54 is shown which can be inserted into the corresponding slot 76. It can be seen that slot 76 is laterally formed across a portion of the bottom of sole 50. The remaining slots are formed in a similar fashion. It is therefore apparent that the slide 54 can be quickly inserted and/or removed to provide a very quick and efficient means of changing the spikes on a golf shoe, not previously attainable in the prior art.

Figure 3B:
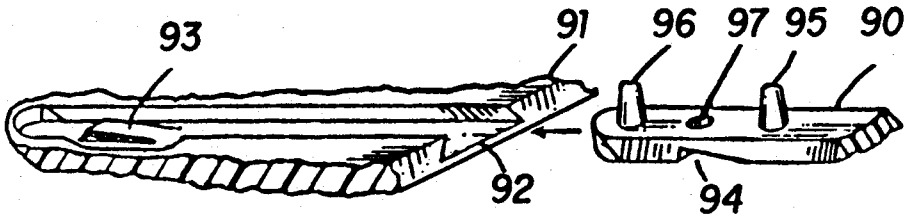
FIG. 3B depicts a perspective view of another aspect of the present invention.

FIG. 3B shows one embodiment of locking a slide 90, which can be slid into slot 92 within sole 91. The slide 90 has spikes 95, 96 embedded in some fashion. Also, slide 90 has a hole 97 drilled therethrough into notch area 94.

Slot 92 includes a spring bias type tab 93 which engages notch 94 in locking engagement when notch 94 slides past the spring bias tab 93. The locking engagement is in the form of a dovetail fashion, as can be seen in FIG. 3B. Other locking aspects of a slide within a slot are of course possible. Once the slide is locked in position, it can be easily removed by inserting a suitable tool (such as a golf tee) through hole 97 to disengage the tab 93 from notch 94. This will then permit easy removal of the slide 90 from slot 92.

In a typical operation with three or four spikes on a particular slide, the slide can be removed in a very few seconds, since they do not have to be screwed in, as required in prior art approaches. Also, the spike location can be at the very outer edges of the sole 50, as will be described in conjunction with the additional Figures to be described below. The present invention thus provides flexibility for walking action as well as desired rigidity laterally.

As will also become apparent, any combination of spikes can be arranged on the bottom of the sole of the golf shoe. One can provide 24 spikes in one embodiment, 20 spikes in another embodiment, 30 in still another embodiment.

Figure 4:
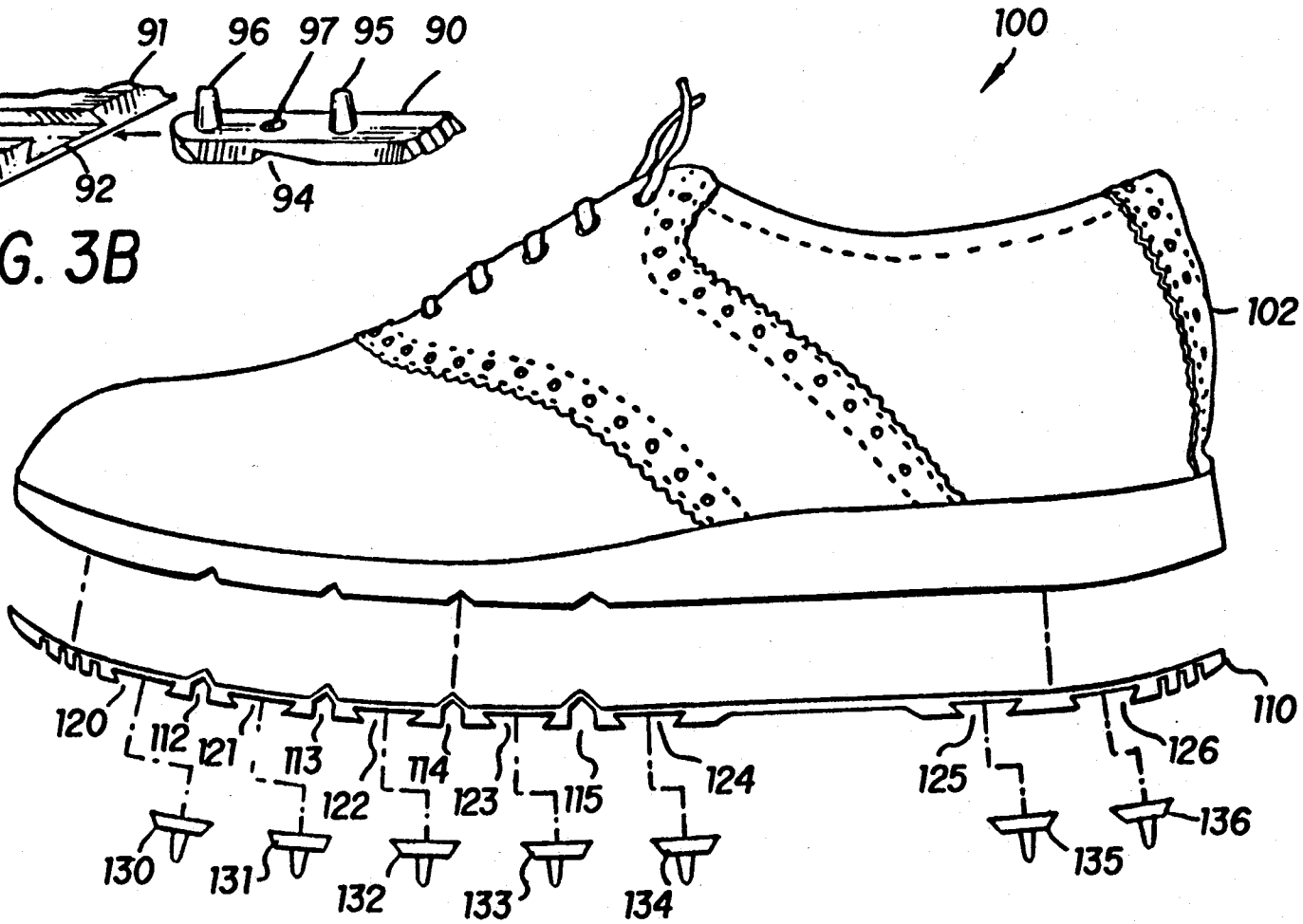
FIG. 4 depicts an exploded side view of another embodiment of the improved golf shoe according to the present invention.

FIG. 4 depicts an embodiment of an improved golf shoe 100 which has an upper portion 102 with an outsole portion 110 constructed in accordance with the present invention.

The sole 110 includes flex channels or grooves 112–115. Also, it can be seen in FIG. 4 that the sole 110 includes the slot portions 120–126. Each slot portion is of a predetermined width at the upper and lower levels which forms a slot adapted to receive a corresponding slide 130–136. It should also become apparent that the slides 130–136 could be connected together integrally by a single strip so as to provide for a single means of inserting or removing a plurality of golf spikes from the golf shoe itself.

As can also be seen, the particular slide can be removed easily by inserting a golf tee or other similar instrument into hole 75 to depress the spring bias portion 80 of the slide 53, as seen in FIG. 3A. This will remove the clamping or locking engagement with the sole portion 50 to provide or facilitate easy removal of the slide 53 from the sole 50.

Figure 5A:
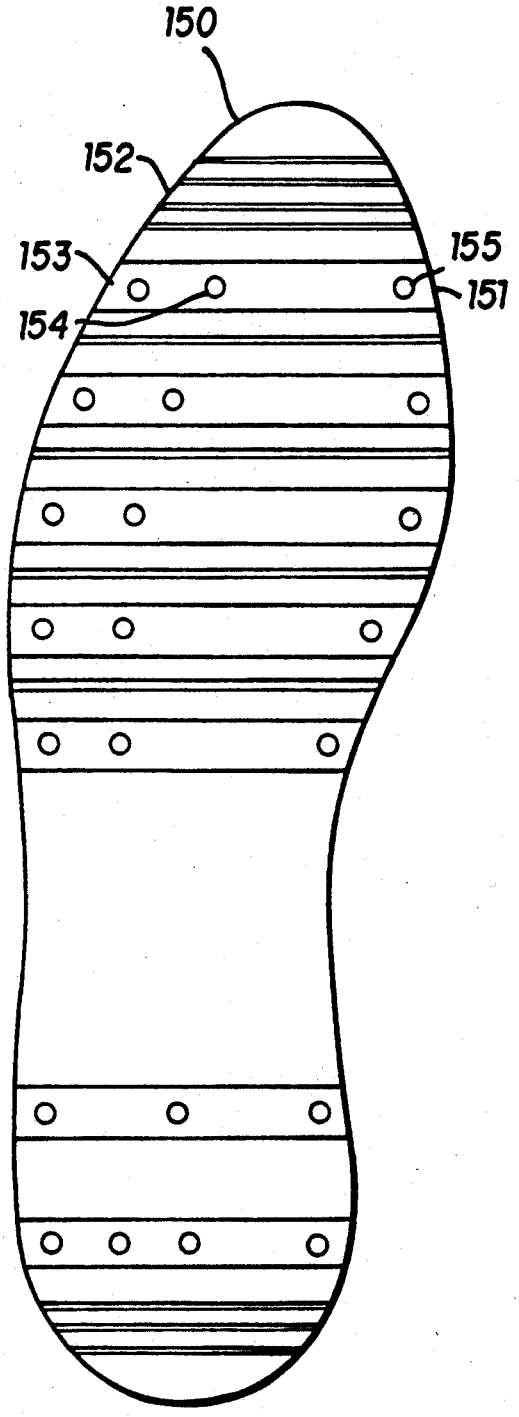
FIGS. 5A, 5B, 6A, and 6B depict configurations of the improved golf shoe for right-handed and left-handed golfers, respectively.
Figure 5B:
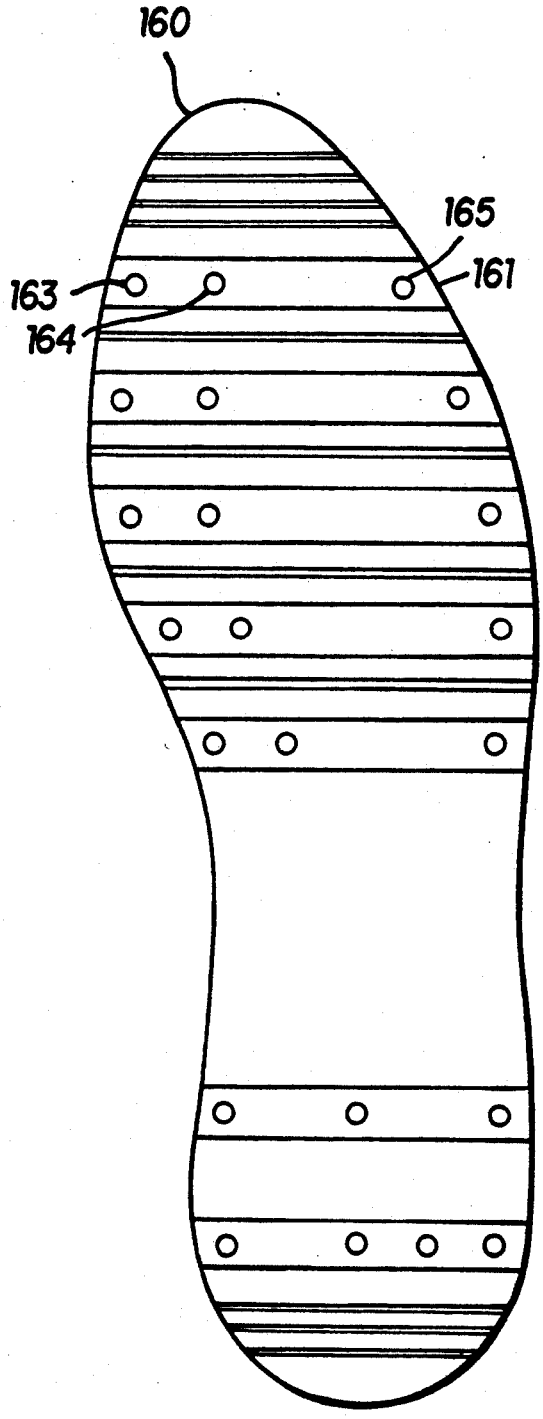

FIGS. 5A and 5B depict an arrangement of a spike arrangement for a right-handed golfer using a pair of shoes 150. The right shoe 152 includes a slide 151 having the golf spikes 153, 154 arranged on the left-hand portion of the bottom of the sole, while only one spike 155 is arranged near the right-hand portion of the bottom of the sole 152. Each slide has a similar arrangement.

Similarly, the left shoe 160 includes a slide 161 having spike arrangements 163, 164 near the left-hand portion of the left shoe, while only a single spike 165 is near the right-hand portion of the left shoe 160. The other slide arrangements could be arranged in a similar fashion.

Also, it can be seen from FIGS. 5A and 5B that the heel portion of the golf shoe could have different arrangements or configurations of the golf spike to again provide for improved traction and durability.

Figure 6A:
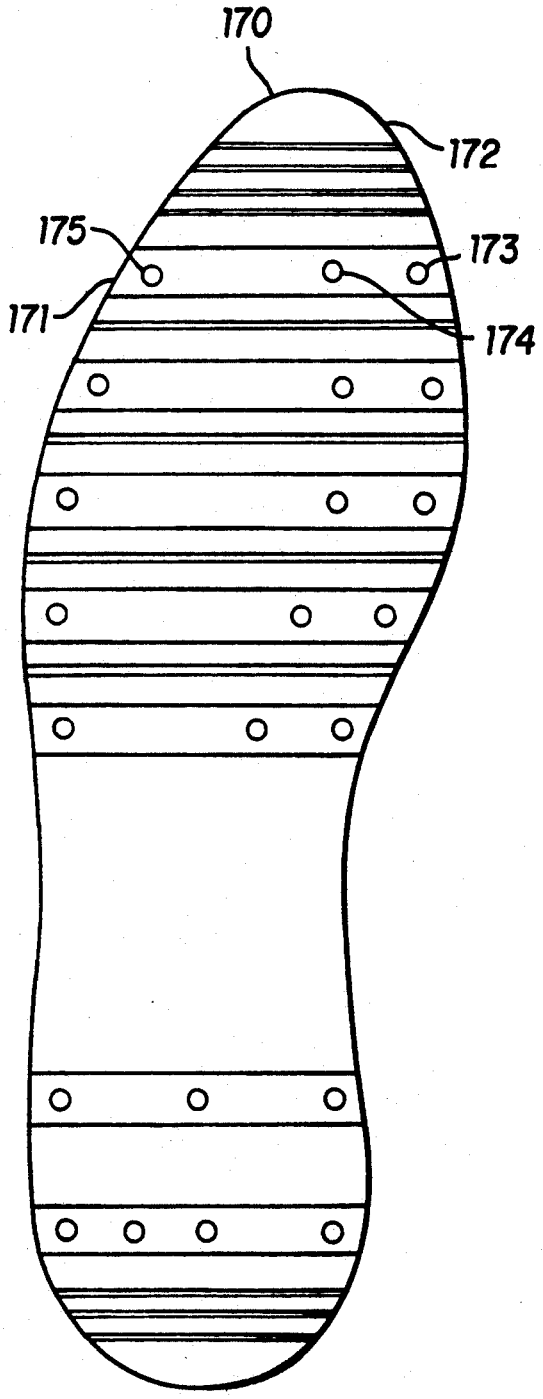
Figure 6B:
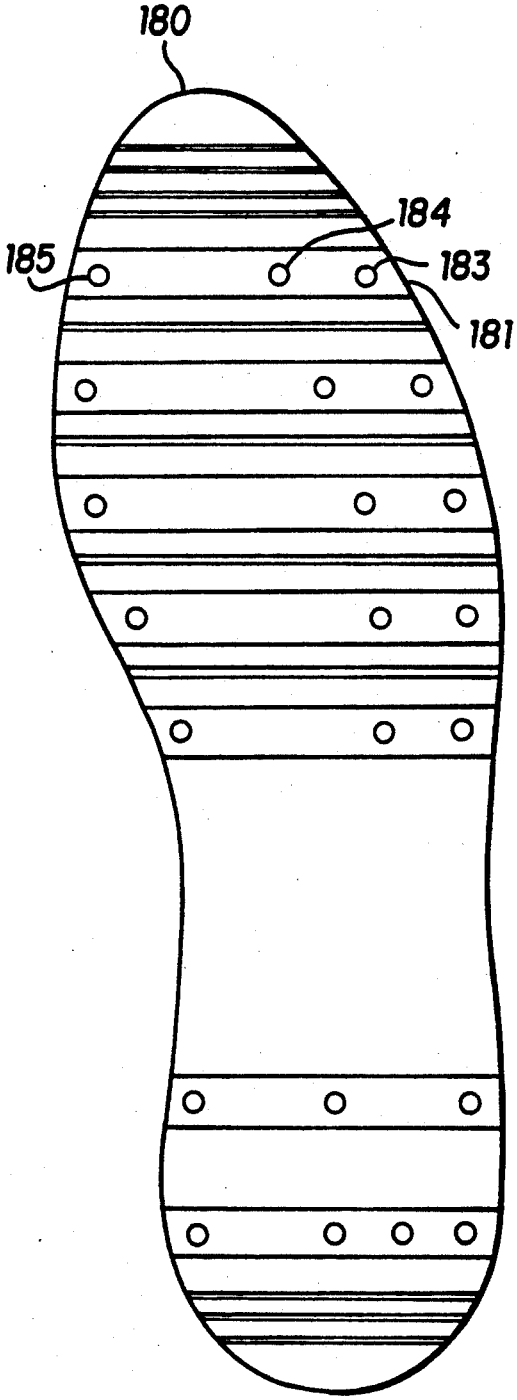

FIGS. 6A and 6B depict a corresponding variation of a golf shoe for a left-handed golfer, 170 being the right shoe, 180 being the left shoe. It can be seen that the arrangement of spikes 171, 173, 174, 175 and 181, 184 and 185 can vary in any desired fashion depending upon the particular needs of an individual wearing the shoes.

Figure 7:
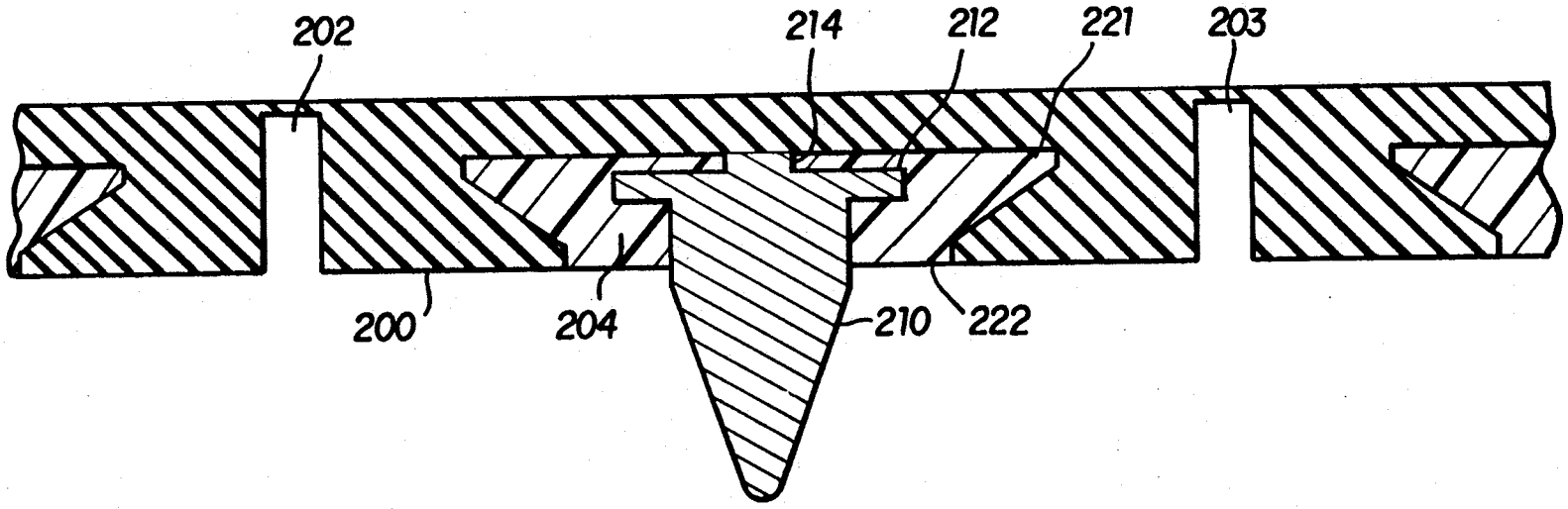
FIG. 7 depicts another cross-sectional view of the sole of the golf shoe showing a further aspect of the present invention.

FIG. 7 depicts a further embodiment of the interaction of a slide with the slot portion of the golf shoe.

In FIG. 7, the sole portion 200 includes, in this preferred embodiment, U-shaped flex channels or grooves 202, 203. Also, the slide portion 204 includes a golf spike 210 arranged with a T-shaped portion 212 ending in a nipple portion 214. This configuration in FIG. 7 permits additional support of the golf spike 210 within the slide portion 204.

In one embodiment, the golf spikes could be merely inserted into the slide itself through a hole drilled through the slide. In FIG. 7, the widest base of the spike base portion 212 of the spike 210 embedded inside the plastic portion of the slide 204. This prevents the spike itself from being moved up or down within the slide 204. In FIG. 7, it can also be seen that the slide portion 204 is made of sufficient width at the upper portion 221, narrowing down to a lesser width at point 222, so that the slide 204 will be in locking engagement with the sole 200.

As seen in FIG. 3A, the sole itself has a raised section to act like a spring which goes up and down opposite to the spring in the back of the slider. The slide then is inserted within the slot and snaps in place.

As previously described, different configurations of the spike arrangement are possible, depending on the need for desired support or traction and whether the golfer is left-handed or right-handed.

As the golfer swings and follows through, his feet can basically roll so that the spike configuration in FIGS. 5A, 5B, 6A and 6B provide for adaptability for the particular golfer.

As also described, the slides can include additional spikes such as on the back heel, which provides extra durability. Also, additional spikes provide improvement over prior art approaches because of the limitation of screw-in golf spikes in such approaches.

Figure 8:
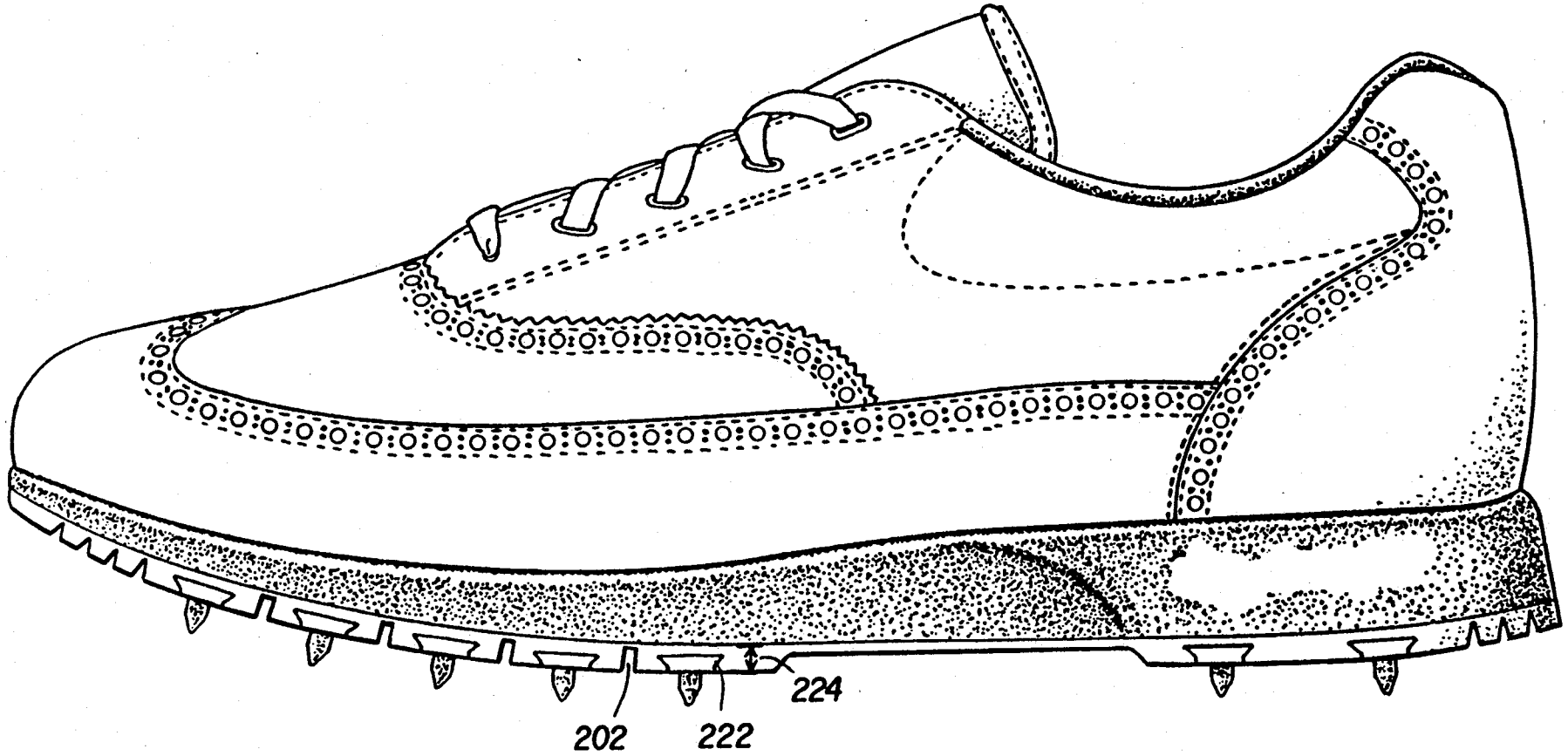
FIG. 8 depicts another embodiment of the present invention.

FIG. 8 shows another embodiment of the present invention in which the thickness of the flex groove is thinner than the thickness of the base of the slide groove. This is so that the shoe only flexes at the thinnest portions (at the flex grooves) and not at the slide portion (so the slide does not bend). For example, in one embodiment, the thickness of the flex groove 220 could be approximately 1/64", while the thickness of the base 222 of the slide 230 approximately 1/16". The thickness of the entire sole 224 at its thickest point is approximately 3/16".

For another embodiment of the present invention, the golf spikes could be made of rubber for a walking shoe, as desired. Furthermore, the spikes could be omitted entirely, and the slide would simply form a portion of the outsole of the shoe.

The spike configuration could also provide for longer or shorter spikes depending on the golf conditions, to provide for better support and traction in the grass as a golfer swings.

Also, the aspects of the present invention could be used for other types of athletic shoes, such as ski boots, snow boots and the like. A rubber sole with plastic or nylon inserts could be used to insert spikes when icy conditions are prevalent.

Other types of athletic shoes which could be utilized with the present invention are football shoes, baseball shoes, and the like.

The foregoing description of the preferred embodiment of the invention has been presented for purposes of illustration and description. It is not intended to be exhaustive or to limit the invention to the precise form disclosed, and many modifications and variations are possible in light of the above teaching. The preferred embodiment was chosen and described in order to best explain the principles of the invention and its practical applications to thereby enable others skilled in the art to best utilize the invention and various embodiments and with varius modifications as are suited to the particular use contemplated. It is intended that the scope of the invention be defined only by the claims appended hereto.

What is claimed is:

1. An athletic shoe comprising:
an upper portion;
a sole affixed to said upper portion;
a slot formed laterally across a bottom portion of said sole;
a spring bias tab disposed within said slot;
a slide, slidably received within said slot;
a locking notch disposed on said slide; and
wherein said spring bias tab and said locking notch engage to lock said slide within said slot.

2. An athletic shoe, as set forth in claim 1, further comprising:
a hole formed within said slide adjacent said locking notch, whereby a tool can be inserted into said hole to disengage said spring bias tab from said locking notch to permit removal of said slide from within said slot.

3. An athletic shoe as set forth in claim 2, further including a spike disposed on said slide.

4. An athletic shoe as set forth in claim 3, wherein said spike includes a plurality of spikes, and wherein at least one of said spikes is arranged adjacent an edge of said sole.

5. An athletic shoe, as set forth in claim 4, wherein said slot and said slide include at least two slots and two corresponding slides, one slot being disposed at a front portion of said sole, the other slot being arranged at a back portion of said sole.

6. An athletic shoe as set forth in claim 1 further including a spike disposed on said slide.

7. An athletic shoe, as set forth in claim 6, wherein said spike includes a plurality of spikes, and wherein at least one of said spikes is arranged adjacent an edge of said sole.

8. An athletic shoe, as set forth in claim 7, wherein said slot and said slide include at least two slots and two corresponding slides, one slot being disposed at a front portion of said sole, the other slot being arranged at a back portion of said sole.

9. An athletic shoe, as set forth in claim 1, wherein said slot is disposed at a front portion of said sole.

10. An athletic shoe, as set forth in claim 1, wherein said slot is disposed at a back portion of said sole.

11. An athletic shoe as set forth in claim 1, wherein said sole is formed of substantially rigid material and has a flexible portion formed laterally therein allowing said sole to flex and wherein said slot is formed in a location different from said flexible portion.

12. An athletic shoe comprising:
an upper portion;
an outsole portion disposed below said upper portion;
a slot formed across a bottom portion of said outsole;
a slide, slidably insertable within said slot;

a spring bias tab disposed on one of said slot and said slide; and a locking notch disposed on the other of said slot and said slide;

wherein said spring bias tab and said locking notch engage to lock said slide within said slot.

13. An athletic shoe as set forth in claim 12, further comprising a hole formed within said slide adjacent said locking notch, whereby a tool can be inserted into said hole to disengage said spring bias tab from said locking notch to permit removal of said slide from said slot.

14. An athletic shoe, as set forth in claim 12, wherein said groove is tilted at approximately a 12 degree angle.

15. An athletic shoe as set forth in claim 12, further comprising:

a groove formed laterally across a bottom portion of said outsole in the area of the ball of the foot forming a flex line allowing said outsole to flex.

16. An athletic shoe as set forth in claim 12, further comprising a midsole portion affixed to said upper portion.

17. An athletic shoe comprising:

an upper portion;

a sole affixed to said upper portion;

a plurality of slots formed laterally within a bottom portion of said sole, a plurality of slides slidably insertable within said slots;

a spike disposed on at least one of said slides, a spring bias tab disposed within each of said slot forming a ramp surface extending into said slot; and locking notch disposed on a side of each of said slides opposite from said spike;

wherein said ramp surface of said spring bias tab is engaged by said locking notch to lock each of said slides within a corresponding slot.

18. An athletic shoe as set forth in claim 17, further comprising:

a hole formed within said slide adjacent said locking notch, whereby a tool can be inserted into said hole to disengage said spring bias tab from said locking notch to permit removal of said slide from within said slot.

19. An athletic shoe as set forth in claim 18, further comprising;

a plurality of spikes disposed along said slide, wherein at least one of said spikes is arranged adjacent an edge of said sole.

20. An athletic shoe as set forth in claim 19, further comprising:

a plurality of grooves formed laterally across the bottom portion of said sole in the ball area of said sole forming flex lines, said flex lines being disposed in locations different from said plurality of slots.

21. An athletic shoe, as set forth in claim 20, said grooves are tilted at approximately a 12 degree angle.

* * * * *